US008960887B2

(12) United States Patent
Onishi et al.

(10) Patent No.: US 8,960,887 B2
(45) Date of Patent: Feb. 24, 2015

(54) MULTIFUNCTIONAL APPARATUS

(75) Inventors: Ryoichi Onishi, Shiojiri (JP); Hideshi Horikawa, Kyoto (JP)

(73) Assignee: Seiko Epson Corporation, Tokyo (JP)

( * ) Notice: Subject to any disclaimer, the term of this patent is extended or adjusted under 35 U.S.C. 154(b) by 99 days.

(21) Appl. No.: 13/198,319

(22) Filed: Aug. 4, 2011

(65) Prior Publication Data

US 2012/0050431 A1 Mar. 1, 2012

(30) Foreign Application Priority Data

Aug. 31, 2010 (JP) ..... 2010-193395

(51) Int. Cl.
*B41J 2/01* (2006.01)
*B41J 25/34* (2006.01)
*B41J 3/60* (2006.01)

(52) U.S. Cl.
CPC ... *B41J 25/34* (2013.01); *B41J 3/60* (2013.01)
USPC ..... 347/101; 347/102; 347/104

(58) Field of Classification Search
CPC ..... B41J 2/01
USPC ..... 347/101, 102, 104
See application file for complete search history.

(56) References Cited

U.S. PATENT DOCUMENTS 6,831,670 B2 * 12/2004 Fujiwara ..... 347/222
8,210,636 B2 * 7/2012 Uematsu ..... 347/16
2006/0181556 A1 * 8/2006 Wanibuchi et al. ..... 347/8
2006/0187504 A1 * 8/2006 Kawashima ..... 358/497
2007/0146457 A1 * 6/2007 Kito ..... 347/101
2008/0165238 A1 * 7/2008 Hiroki et al. ..... 347/104
2009/0185021 A9 * 7/2009 Lyons et al. ..... 347/190
2009/0189337 A1 * 7/2009 Yamamoto ..... 271/189
2010/0061743 A1 * 3/2010 Uematsu ..... 399/38
2010/0073449 A1 * 3/2010 Yamamoto et al. ..... 347/104

FOREIGN PATENT DOCUMENTS

JP 11-035168 2/1999
JP 2003-182172 7/2003
JP 2009-179415 8/2009
JP 2009-233888 * 10/2009 ..... B41J 11/70

* cited by examiner

*Primary Examiner* — Manish S Shah
*Assistant Examiner* — Jeremy Delozier
(74) *Attorney, Agent, or Firm* — Workman Nydegger

(57) ABSTRACT

A multifunctional apparatus includes a first functional part and a second functional part in a housing of the multifunctional apparatus when the multifunctional apparatus is operated. In the multifunctional apparatus, the first functional part is configured to be movable by a movement unit such that the first functional part is located at a defined maintenance position on the outside of the housing when maintenance is performed on the first functional part and the second functional part is configured to be detachably attached to the housing of the multifunctional apparatus. Further, a movement path on which the first functional part is moved from the operation position to the maintenance position by the movement unit is present on at least a portion of an occupied space region occupied by the second functional part in the housing when the second functional part is attached to the multifunctional apparatus.

7 Claims, 6 Drawing Sheets

MULTIFUNCTIONAL APPARATUS

BACKGROUND

The entire disclosure of Japanese Patent Application No: 2010-193395, filed Aug. 31, 2010 is expressly incorporated by reference herein.

1. Technical Field

The present invention relates to a multifunctional apparatus including a plurality of functional parts having different functions.

2. Related Art

A recording apparatus having a recording portion which forms and records a predetermined image (including characters, figures, and the like) onto a transported recording medium (for example, paper) by ejecting and attaching liquid (for example, ink) as recording liquid onto the recording medium has been known. In such recording apparatus, if a long recording medium wound in a roll form, for example, is fed to the recording portion, a plurality of images are continuously recorded onto the recording medium which is continuously transported on the recording portion in some case. In such case, the recording apparatus serves as one type of a multifunctional apparatus having many functions. For example, the recording apparatus as the multifunctional apparatus has a function of cutting the recording medium on which the plurality of images have been recorded into a length in accordance with a recording region of each image, a function of printing identification characters such as a serial number on a back face which is the side opposite to a recording face on the cut recording medium, and the like.

As an example of such recording apparatus as one type of the multifunctional apparatus, a printer including functional parts of a cutter unit and a back printing unit is described in JP-A-2009-179415. Further, in the printer of this type, a scrap container in which cut scraps of a recording medium (paper), which has been cut by the cutter unit, are received and accumulated is provided as another functional part.

Maintenance is normally required to be performed on the functional part like the back printing unit used in such type of printer as described in JP-A-2009-179415. To be more specific, when a predetermined number of characters have been printed, expendable supplies such as a ribbon are required to be exchanged, the back printing unit is required to be cleaned, and so on, as the maintenance.

However, in a housing of the printer, a recording medium is present in the vicinity of the upper side of the back printing unit and a scrap container is arranged at the lower side of the back printing unit. Therefore, it is difficult to perform maintenance in a state where the back printing unit is located in the housing of the printer. Accordingly, the back printing unit is needed to be taken out of the housing. In order to take the back printing unit out of the housing, it is desirable that a space region serving as a movement path for taking out the back printing unit to a position at the outside of the housing where maintenance can be performed on the back printing unit is provided in the housing. However, if such space region is provided, there arises a problem in that the printer is increased in size.

SUMMARY

An advantage of some aspects of the invention is to provide a multifunctional apparatus which is suppressed from increasing in size by suppressing a space region required to move a functional part from an operation position to a maintenance position from being added in a housing.

A multifunctional apparatus according to an aspect of the invention includes a first functional part and a second functional part having different functions. In the multifunctional apparatus, the first functional part is located at a defined operation position in a housing of the multifunctional apparatus when the multifunctional apparatus is operated and is configured to be movable by a movement unit such that the first functional part is located at a defined maintenance position on the outside of the housing when maintenance is performed on the first functional part, the second functional part is located in the housing of the multifunctional apparatus when the multifunctional apparatus is operated and is configured to be detachably attached to the housing of the multifunctional apparatus, and a movement path on which the first functional part is moved from the operation position to the maintenance position by the movement unit is present on at least a portion of an occupied space region occupied by the second functional part in the housing when the second functional part is attached to the multifunctional apparatus.

With this configuration, the first functional part is moved using an occupied space region of the second functional part. Accordingly, if the attached second functional part is pulled out, the first functional part can be moved from the operation position to the maintenance position. As a result, a space region required to move the first functional part from the operation position to the maintenance position can be suppressed from being added in the housing. Therefore, the multifunctional apparatus can be suppressed from increasing in size.

In the multifunctional apparatus according to the aspect of the invention, it is preferable that the first functional part be moved from the operation position to the gravity direction side in the vertical direction and be moved in the horizontal direction so as to be located at the maintenance position by the movement unit.

With this configuration, when the movement unit moves the first functional part from the operation position, the movement unit moves the first functional part in the gravity direction. Accordingly, the first functional part can be moved easily by free fall of the first functional part, for example. Further, when the movement unit moves the first functional part to the maintenance position, the movement unit moves the first functional part in the horizontal direction. Accordingly, the first functional part can be easily moved to the maintenance position by drawing the first function part in the horizontal direction.

In the multifunctional apparatus according to the aspect of the invention, it is preferable that a movement direction of the first functional part when the first functional part is moved to the maintenance position by the movement unit be the same as a direction to which the attached second functional part is pulled out from the housing.

With this configuration, for example, when a maintenance operator of the multifunctional apparatus pulls out the second functional part to move the first functional part from the operation position to the maintenance position in order to perform maintenance on the first functional part, the direction of pulling out the second functional part and the movement direction of the first functional part are the same. As a result, when the operator moves the first functional part, a probability that the operator can move the first functional part without moving in the wrong direction is increased.

In the multifunctional apparatus according to the aspect of the invention, it is preferable that the movement unit include a link mechanism which moves one base on which a movement table is provided with four link members and a slide mechanism which makes the movement table provided on the base slide in the same direction as the direction to which the second functional part is pulled out from the housing, and the first functional part be placed on the movement table.

With this configuration, when the first functional part is moved from the operation position to the maintenance position, the movement unit moves the first functional part in the gravity direction and the horizontal direction at the same time by the link mechanism, for example. Thereafter, the movement unit further moves the first functional part to the outside of the housing by the slide mechanism. Accordingly, when a large slide amount is needed, the first functional part can be moved to the outside of the housing by providing the link mechanism and the slide mechanism in the above manner.

In the multifunctional apparatus according to the aspect of the invention, it is preferable that when the first functional part is moved from the maintenance position to the operation position, in a state before the first functional part is located at the operation position, the first functional part be moved by the movement unit in a floating state where the position of the first functional part in the vertical direction and the horizontal direction is not fixed, and when the first functional part is located at the operation position, the position of the first functional part in the vertical direction and the horizontal direction be determined by a positioning member so that the first functional part is positioned at the operation position.

With this configuration, when the first functional part is moved in the antigravity direction so as to be located at the operation position, the first functional part can be positioned at the operation position with the positioning member projected from the antigravity direction side to the gravity direction side. At this time, if a state before positioning is made to be a floating state, a positional error of the first functional part in the vertical direction and the horizontal direction, which is caused in the state before positioning, is absorbed. Therefore, the first functional part can be positioned at the operation position accurately.

In the multifunctional apparatus according to the aspect of the invention, it is preferable that the multifunctional apparatus have a function of cutting a recording medium having a plurality of recording regions on one face for each of the recording regions, and a function of performing printing on the cut recording medium at a face opposite to the one face, and the first functional part be a printing unit which performs printing on the face opposite to the one face, and the second functional part be a container in which cut pieces of the recording medium generated between the recording regions by the cutting are accumulated.

With this configuration, since the second functional part is a container in which cut pieces of the recording medium are accumulated, the second functional part is required to occupy a space region enough to reliably take in and accumulate the cut pieces in the housing. Further, since the printing unit performs printing on the recording medium after being cut, the printing unit is arranged in the vicinity of the container for accumulating the cut pieces. Accordingly, the occupied space region occupied by the container for accumulating the cut pieces can be used for the movement path on which the printing unit is moved for maintenance.

In the multifunctional apparatus according to the aspect of the invention, it is preferable that the multifunctional apparatus further include a transportation unit which transports the recording medium, and a liquid ejecting head which ejects recording liquid onto the recording regions of the transported recording medium in a gravity direction to perform recording on the recording regions. In the multifunctional apparatus, it is preferable that the multifunctional apparatus function as a recording apparatus onto the recording medium.

With this configuration, in the recording apparatus, the same effects as those in the above multifunctional apparatus can be obtained.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the invention is described using an embodiment which is embodied in a recording apparatus as one type of a multifunctional apparatus. The recording apparatus as one type of the multifunctional apparatus records an image by ejecting ink as recording liquid from a liquid ejecting head onto a paper P as a long recording medium fed from a roll paper RP wound in a roll form.

Figure 1:
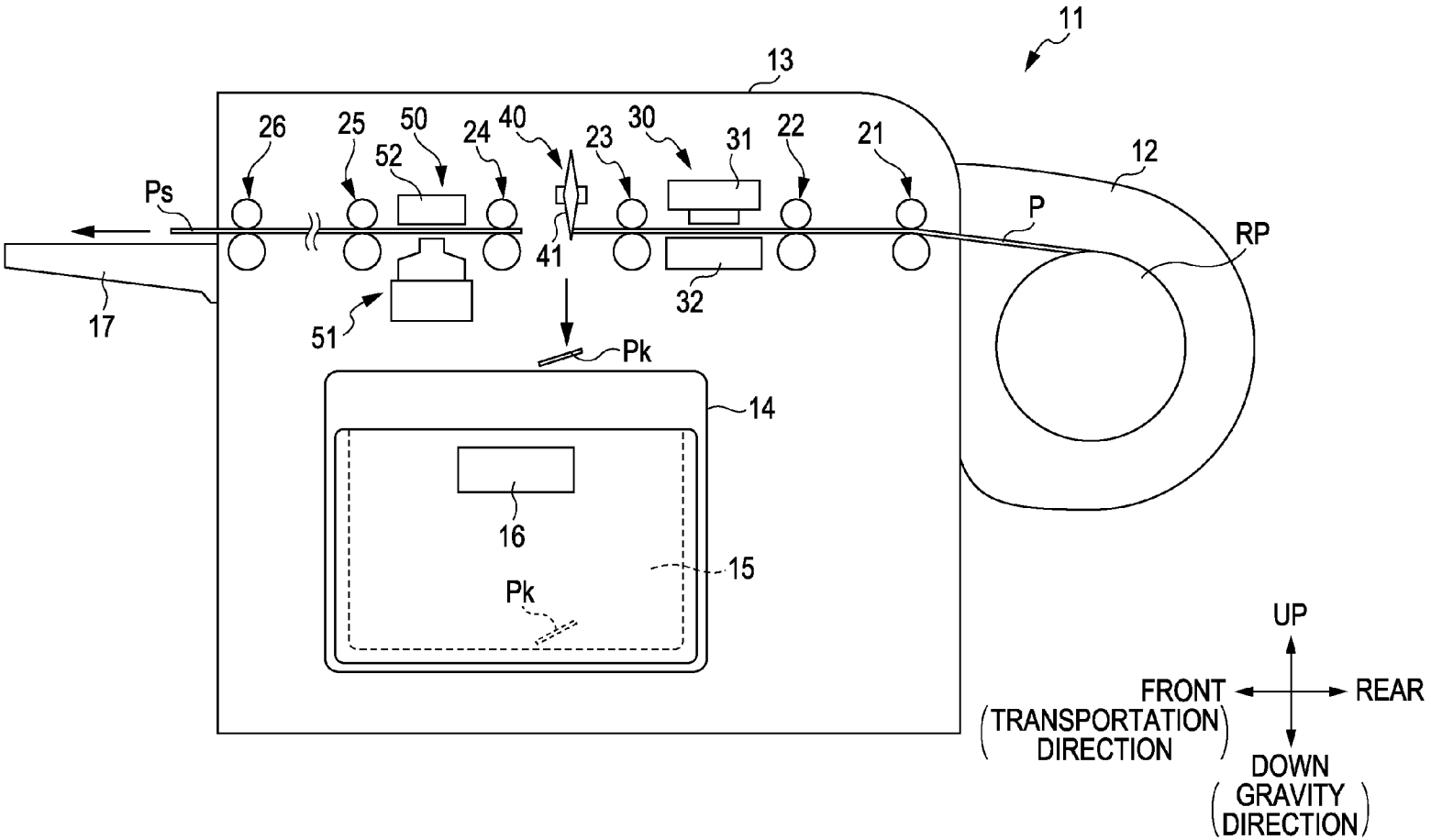
FIG. 1 is a functional block diagram illustrating a schematic configuration of a printer according to an embodiment.

FIG. 1 is a block configuration diagram illustrating a printer 11 as an example of a recording apparatus according to the embodiment. It is to be noted that in order to allow the following description to be easily made, the gravity direction is referred to as a downward direction and the opposite direction to the gravity is referred to as an upward direction. Further, a transportation direction which intersects with both the above directions and in which the fed paper P is transported when an image is recorded is referred to as a front direction. A direction which is opposite to the transportation direction is referred to as a rear direction. In addition, a direction which intersects with both of the gravity direction and the transportation direction is referred to as a right direction (paper-plane forward direction) or a left direction (paper-plane backward direction) when seen from the front direction.

As illustrated in FIG. 1, the printer 11 includes a case 12 and a main body case 13. The roll paper RP is accommodated in the case 12. Functional blocks including a recording portion 30, a cutting portion 40, a back printing portion 50, and the like, which perform processings on the paper P fed from the roll paper RP, are provided in the main body case 13 as a housing. Further, a paper discharge tray 17 is provided at the front side of the main body case 13. A paper Ps on which recording has been performed and which has been cut is discharged onto the paper discharge tray 17. Further, a container (hereinafter, referred to as "scrap container") 15 which receives and accumulates cut pieces Pk generated by cutting the paper P is arranged in a concave portion 14. The concave portion 14 is formed on a right side face of the main body case 13 and a face thereof is slightly concaved from the surface of the main body case 13. The scrap container 15 can be pulled out from the main body case 13 in the right direction perpendicular to the transportation direction in the embodiment. An end face of the scrap container 15 at the right side is exposed on the concave portion 14. Further, a handle 16 for pulling out the scrap container 15 is provided on the end face thereof.

The functional blocks provided on the printer 11 are described in accordance with the transportation order of the paper P which is transported by a plurality of roller pairs functioning as transportation units included in the printer 11. At first, the paper P unrolled from the roll paper RP is fed to the recording portion 30 by a feeding roller pair 21. The recording portion 30 has a liquid ejecting head 31 which ejects ink, a supporting table 32 which supports the paper P, and transportation roller pairs 22, 23 which transport the paper P.

The recording portion 30 transports the paper P fed from the roll paper RP and records an image on the upper face (surface) of the paper P. At first, the paper P is fed to a position between the liquid ejecting head 31 and the supporting table 32 by the transportation roller pair 22. The upper face (surface) of the fed paper P is transported while keeping a predetermined distance with respect to the liquid ejecting head 31. At this time, ink is ejected from the liquid ejecting head 31 onto the upper face of the paper P so that an image is recorded. Thereafter, the paper P is transported to the cutting portion 40 as a subsequent functional block by the transportation roller pair 23. It is to be noted that the liquid ejecting head 31 can be constituted by a so-called serial type head or a so-called line head type head. The serial type head is mounted on a carriage moving in the width direction of the transported paper P. On the head of the line head type, nozzles are formed over substantially paper width on a head main body which is fixedly arranged along the width direction of the paper P.

The cutting portion 40 has a cutter 41 constituted by a rotary blade or the like as a functional part and cuts the paper P for each recording region corresponding to the recorded image. At this time, the cutting portion 40 cuts the paper P so as to remove unnecessary recording regions present at ends of each recording region in the transportation direction. Therefore, as illustrated in FIG. 1, when the paper P is cut, a cut piece Pk is generated and the generated cut piece Pk falls in the gravity direction. Accordingly, the scrap container 15 as a functional part (corresponding to a second functional part) is arranged at the lower side with respect to the cutting portion 40 in order to receive and accumulate the falling cut piece Pk.

The paper Ps after being cut is transported to the back printing portion 50 on which characters are printed on a back face. The back printing portion 50 has a printing unit 51 as a functional part (corresponding to a first functional part), a supporting table 52 which supports the paper Ps from the upper side at the time of the printing and transportation roller pairs 24, 25 which transport the paper Ps. The back printing portion 50 feeds the transported paper Ps to a position between the printing unit 51 and the supporting table 52 by the transportation roller pair 24, at first. Then, dots are recorded on the lower face (back face) of the fed paper Ps by the printing unit 51 so that predetermined characters are printed thereon. Then, the fed paper Ps is fed in the transportation direction by the transportation roller pair 25.

Thereafter, the paper Ps is transported to a dryer unit (not illustrated) as a functional block, for example, and experiences processings such as drying by a heater unit (not illustrated) as a functional block, and the like. Finally, the paper Ps is discharged onto the paper discharge tray 17 by the transportation roller pair 26.

A so-called impact dot type printer unit which forms ink dots by pressing an ink ribbon against the lower face (back face) of the paper Ps is used as the printing unit 51 in the printer 11 according to the embodiment. Accordingly, as is well known, an operation of exchanging the ink ribbon as an expendable supply is required. In the printer 11 according to the embodiment, in order to perform maintenance operations on the printing unit including the operation of exchanging the ink ribbon, the printing unit 51 can be taken out of the main body case 13 without taking apart the main body case 13. It is to be noted that a thermal transfer type printer other than the impact dot type printer can be also employed.

Figure 2:
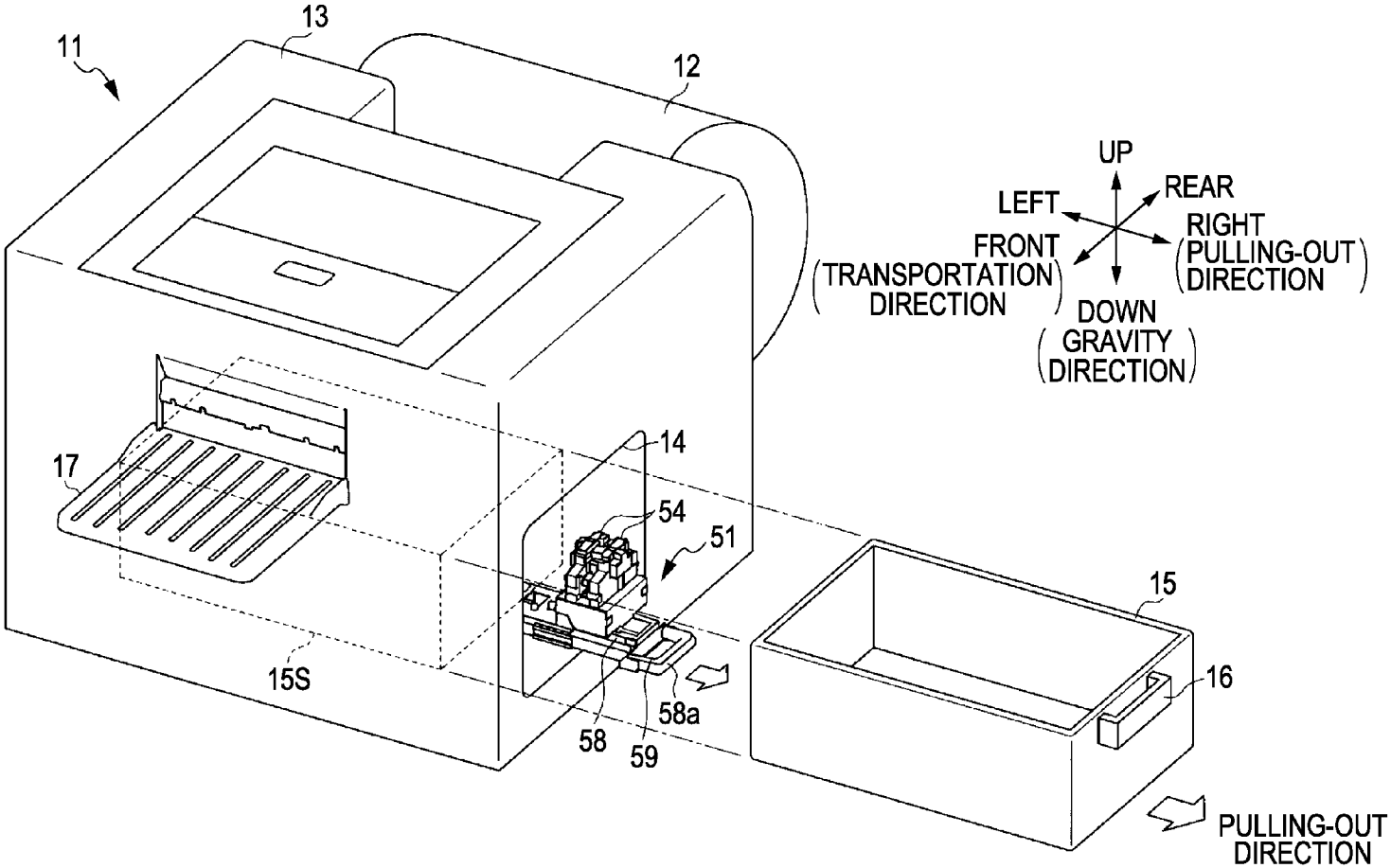
FIG. 2 is a perspective view illustrating a drawing state of a printing unit in the printer according to the embodiment.

That is to say, as illustrated in FIG. 2, the scrap container 15 is pulled out from the main body case 13 by gripping the handle 16 exposed on the concave portion 14 of the main body case 13, at first. It is to be noted that the pulling-out direction corresponds to the right direction. An occupied space region 15S which has been occupied by the scrap container 15 is generated as a hollow space in which any members are not present in the main body case 13 by pulling out the scrap container 15. If at least a portion of the occupied space region 15S is used as a movement path, the printing unit 51 can be moved from an operation position to a maintenance position as illustrated in FIG. 2. The operation position is a position at which the printing unit 51 performs printing on the paper Ps. The maintenance position is a position at which maintenance operations can be performed on the printing unit 51.

In the embodiment, the printing unit 51 has two print heads 54 and an ink ribbon is exchanged for each of the heads. Further, the printing unit 51 is placed on a movement table 58. The printing unit 51 can be drawn to the outside of the main body case 13 by gripping and drawing a drawer handle 58*a* provided at the pulling-out direction side (right side) of the movement table 58. Further, in the embodiment, an unfixing handle 59 for cancelling a state where the printing unit 51 is fixed at the operation position at which the printing unit 51 performs printing on the paper Ps is provided. The unfixing handle 59 is supplementarily described later.

Next, the printing unit 51 is configured so as to move from the operation position to the maintenance position by a movement unit included in the printer 11. The movement of the printing unit 51 by the movement unit is described in the following manner. At first, a state where the printing unit 51 is located at an operation position DP in a state where the printer 11 is operated is described with reference to FIG. 3. Thereafter, a state where the printing unit 51 is moved to be located at a maintenance position MP is described with reference to FIG. 4.

Figure 3:
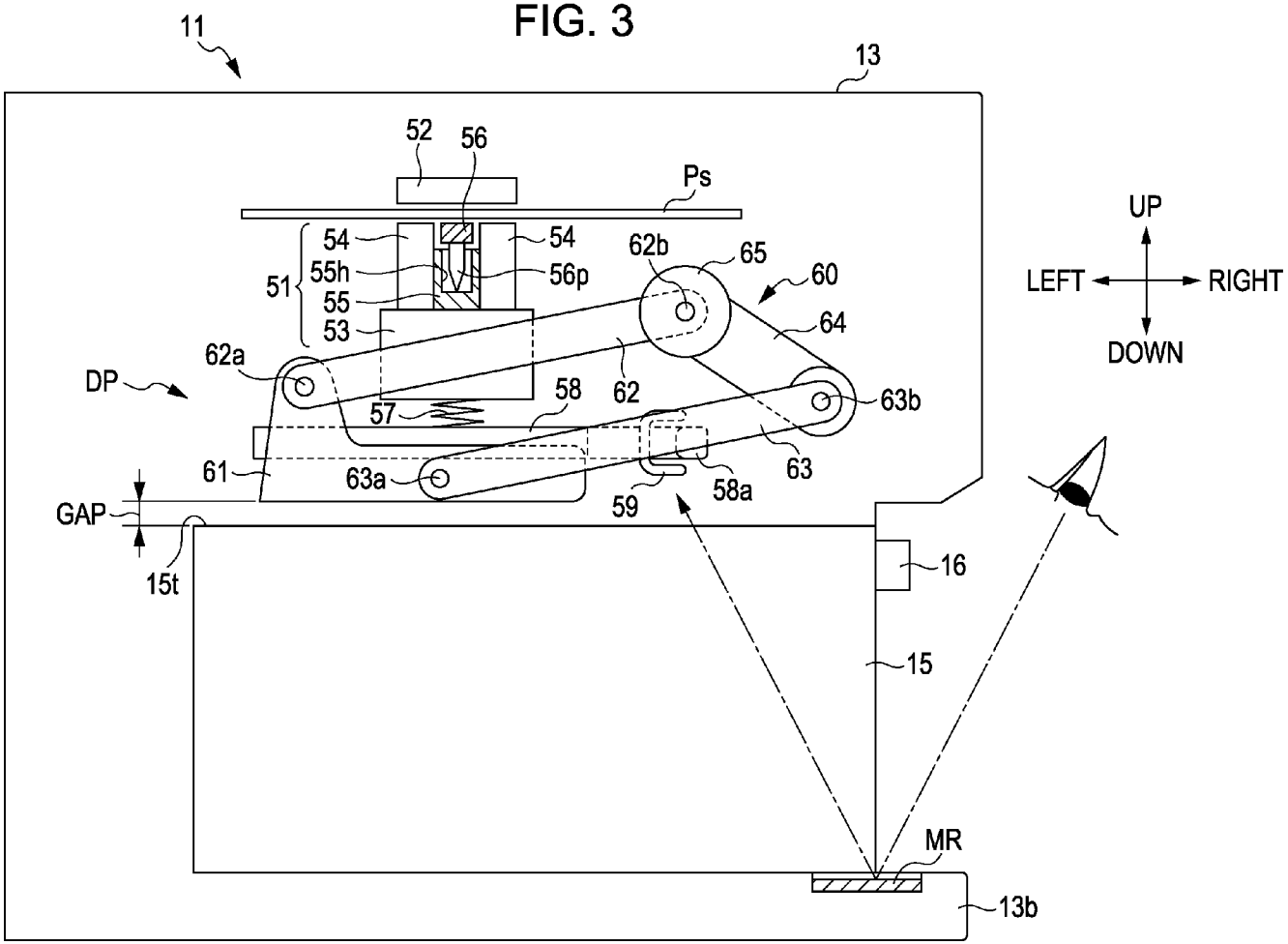
FIG. 3 is a configuration descriptive view of the printer including a state view of a link mechanism for moving the printing unit in a case where the printing unit is located at an operation position.

As illustrated in FIG. 3, the printing unit 51 is in a state where the print heads 54 are arranged in the vicinity of the back face of the paper Ps so as to form dots by transferring inks of the ink ribbons onto the paper Ps supported by the supporting table 52 in the operation state. The printing unit 51 has a unit base 53 on which the two print heads 54 are mounted and an inter-head frame body 55 provided between the two print heads 54. Two guiding holes 55*h* are provided on the inter-head frame body 55 at the front and rear sides. The unit base 53 is placed on the movement table 58 in a floating state where the unit base 53 can be moved in any of the upward-downward, left-right, front-rear directions with one or more coil springs 57.

A fixing frame 56 which is fixed to the main body case 13 is provided between the two print heads 54 at the side of the main body case 13 of the printer 11. Two guiding pins 56*p* are provided on the fixing frame 56 at the front and rear sides. The guiding pins 56*p* have shapes projected in the downward direction which is the opposite to the movement direction of the printing unit 51 to the operation position DP.

Further, when the printing unit 51 is moved from the downward direction side to the upward direction so as to be located at the operation position DP, the guiding pins 56*p* and the guiding holes 55*h* formed on the inter-head frame body 55 are engaged with each other. Pin shapes and hole shapes are set such that the printing unit 51 is positioned in all of the upward-downward, left-right, front-rear directions with the engagement. Accordingly, the guiding pins 56*p* and the guiding holes 55*h* function as positioning members. It is to be noted that in the embodiment, the printing unit 51 is fixed by a lock mechanism (not illustrated) in a state where the printing unit 51 is positioned in the above manner, that is, a state where the printing unit 51 is located at the operation position DP. As the lock mechanism, for example, a lock mechanism which prevents the base 61 or the movement table 58 from being moved at least in the downward direction may be employed.

The movement table 58 is provided so as to be slidable with respect to the base 61 in the left-right direction. The drawer handle 58*a* is provided on the right end of the movement table 58. The unfixing handle 59 is arranged at the left side of the drawer handle 58*a* while keeping a space with each other between the unfixing handle 59 and the drawer handle 58*a* as described above. When a maintenance operator grips the drawer handle 58*a* from the lower side by hand (one hand), for example, the maintenance operator can also grip the unfixing handle 59 together with the drawer handle 58*a*. In addition, the unfixing handle 59 can be slid to the side of the drawer handle 58*a* with a gripping force. The lock by the lock mechanism is cancelled by the sliding of the unfixing handle 59 so that a state where the printing unit 51 is fixed at the operation position DP is cancelled.

The base 61 has a substantially rectangular shape and flat side faces perpendicular to the front-rear direction are formed on both ends thereof in the front-rear direction (which is the direction perpendicular to a paper plane). Two plate-form link members 62, 63 are provided on each of the side faces. One end of each link member 62 is rotatably, axially supported onto the base 61 by a rotating shaft 62*a*. One end of each link member 63 is rotatably, axially supported onto the base 61 by a rotating shaft 63*a*. Further, the other end of each link member 62 is rotatably, axially supported onto a fixing plate 64 fixed to the side of the main body case 13 by a rotating shaft 62*b*. The other end of each link member 63 is rotatably, axially supported onto the fixing plate 64 by a rotating shaft 63*b*. The link members 62, 63 are arranged so as to be substantially parallel with each other. Thus, four link members in total including two link members 62 and two link members 63 which are provided at both ends of the base 61 in the front-rear direction constitute a link mechanism 60. The base 61 is configured so as to be movable while keeping a horizontal state without being inclined by the link mechanism 60.

In the embodiment, dampers (rotary dampers) 65 are attached between the link members 62 and the fixing plates 64 on the rotating shafts 62*b*. The dampers 65 decrease a rotating speed of the link members 62 by generating a buffering force (also referred to as damper force) on the rotation of the link members 62 which rotate about the rotating shafts 62*b*. With this, when the printing unit 51 is moved to the maintenance position MP (see, FIG. 4) from the operation position DP by the link mechanism 60, the printing unit 51 is moved slowly. It is to be noted that the rotating shafts on which the dampers 65 are provided are not necessarily limited to the rotating shafts 62*b* and the dampers 65 may be attached to other rotating shafts such as the rotating shafts 63*b*. Further, it is needless to say that the dampers 65 may be attached to a plurality of rotating shafts.

When the printing unit 51 is moved from the operation position DP to the maintenance position MP, the operation of pulling out the scrap container 15 is performed by an operator, at first, as described above. In the embodiment, as illustrated in FIG. 3, the scrap container 15 is arranged such that a space GAP is formed between a lowermost face of the base 61 and an uppermost face 15*t* of the scrap container 15. Accordingly, the operator can grip the handle 16 and draw and pull out the scrap container 15 from the main body case 13.

The base 61 (movement table 58) is located at the upper side with respect to the scrap container 15 in the main body case 13. Therefore, in order to check the position of the drawer handle 58*a*, the operator has to look up at the drawer handle 58*a* from the lower side of the main body case 13. In general, a posture of looking up from the lower side is not comfortable for the operator in comparison with a posture of looking down from the upper side. Further, in the case of looking up from the lower side, when the drawer handle 58*a* is located at a position at which the drawer handle 58*a* is hidden behind the main body case 13, for example, the drawer handle 58*a* cannot be visually recognized in some case. In order to solve the problem, in the embodiment, a reflection mirror MR is provided so as to make the drawer handle 58*a* (unfixing handle 59) be visually recognized easily in a state where the scrap container 15 has been pulled out. The reflection mirror MR having a predetermined reflection area is provided on a lower portion 13*b* of the main body case 13 on the concave portion 14 provided on the main body case 13. That is, as illustrated in FIG. 3, the position of the drawer handle 58*a* can be checked from the upper side by inverting thereof with the reflection mirror MR.

It is preferable that an arrangement position of the reflection mirror MR and a shape and a size of a reflection face be set such that the drawer handle 58*a* can be visually recognized easily in consideration of a practical workability, of course. Further, the reflection mirror MR may be configured so as to be movable in the left-right, front-rear, and upward-downward directions or be inclined with respect to the horizontal direction after the scrap container 15 has been pulled out, for example. In addition, the reflection face is not limited to be a flat face and may be a concave face or a convex face. Further, it is sufficient that as a material of the reflection mirror, in addition to a glass which is normally used, a metal which is hard to be broken or a resin may be used.

Figure 4:
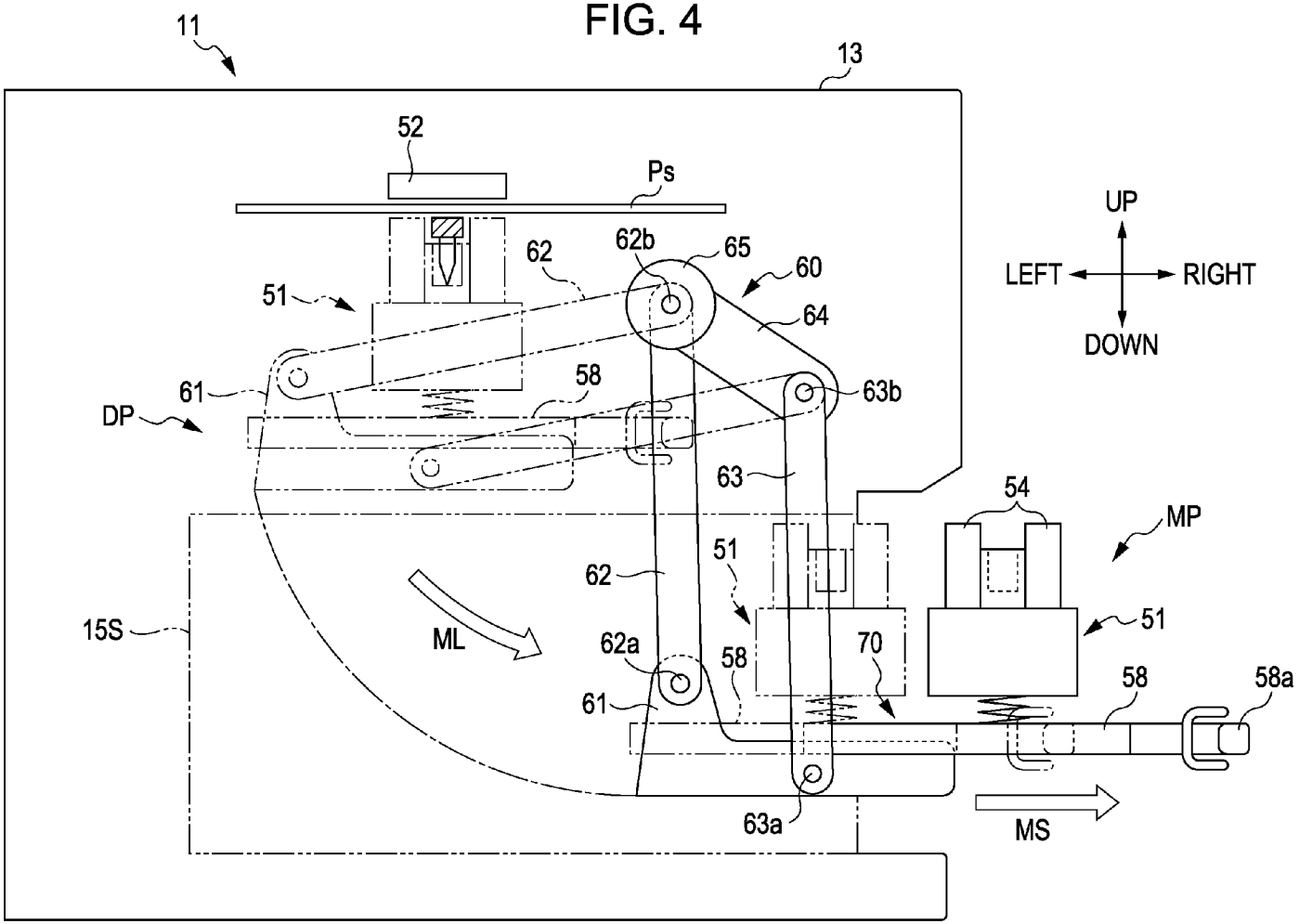
FIG. 4 is a configuration descriptive view of the printer including a state view of the link mechanism for moving the printing unit in a case where the printing unit is located at a maintenance position.

Next, if the unfixing handle 59 is slid so that the lock is cancelled, the printing unit 51 is moved to the maintenance position MP as illustrated in FIG. 4. That is to say, the base 61 starts to be moved from the operation position DP by the link mechanism 60 while a main movement direction thereof is set to the downward direction, at first. Further, the base 61 is moved in the occupied space region 15S on a movement path ML on which the main movement direction is gradually changed to the right direction as is the horizontal direction while keeping the horizontal state. Accordingly, the movement table 58 provided on the base 61 and the printing unit 51 placed on the movement table 58 through the coil spring(s) 57 are moved together with the movement of the base 61. At this time, the movement table 58 and the printing unit 51 are moved such that movement paths thereof are present on at least a portion of the occupied space region 15S. In this manner, the link mechanism 60 functions as a movement unit of the printing unit 51.

In the embodiment, the base 61 (printing unit 51) is moved in the downward direction as the gravity direction, that is, including the falling direction. Then, at the time of the movement in the downward direction, the base 61 is slowly moved with the damper force of the dampers (rotary dampers) 65 which are attached to the rotating shafts 62*b* such that the base 61 (printing unit 51) does not fall rapidly. It is to be noted that in the embodiment, the dampers 65 have one way clutch mechanisms so as not to generate torque when the base 61 is moved in the upward direction, that is, when the printing unit 51 is returned to the operation position. Accordingly, the operator can move the printing unit 51 to the operation position DP without using a large force.

In the printer 11 according to the embodiment, the link mechanism 60 is configured such that the base 61 is moved to the right side as much as possible in a range where the printing unit 51 is positioned in the occupied space region 15S by the link mechanism 60. That is to say, as illustrated in FIG. 4, the printing unit 51 is configured to be moved to a position slightly beyond a lowermost point of the movement by the link mechanism 60.

The printing unit 51 is still located in the main body case 13 in this state. Therefore, in the printer 11 according to the embodiment, the movement table 58 can be moved to the right side further. For example, although not illustrated in the drawing, a rail guide provided on the base 61 and a slide rail provided on the movement table 58 constitute a slide mechanism 70 between the base 61 and the movement table 58. Accordingly, with the slide mechanism 70, the operator can further move the printing unit 51 along a movement path MS in the horizontal direction subsequent to the movement on the movement path ML by drawing the drawer handle 58*a* in the right direction. Therefore, in the embodiment, the slide mechanism 70 functions as the movement unit in addition to the link mechanism 60. As a result, as illustrated in FIG. 4, the printing unit 51 can be drawn to the outside of the main body case 13 so as to be located at the maintenance position MP.

It is to be noted that when the printing unit 51 is returned from the maintenance position MP to the operation position DP, it is sufficient that the slide mechanism 70 and the link mechanism 60 functioning as the movement units are made to perform operations reverse to the above-described operations. That is to say, the movement table 58 is returned onto the base 61 by the slide mechanism 70 by pushing the drawer handle 58*a* in the left direction. Subsequently, the base 61 is moved while changing the main movement direction from the left direction to the upward direction by the link mechanism 60 by pushing the drawer handle 58*a* in the left direction further. Then, as described above, the printing unit 51 can be positioned at the operation position DP and locked.

According to the first embodiment as described above, the following effects can be obtained.

1. The printing unit 51 is moved using the occupied space region 15S of the scrap container 15. Accordingly, if the attached scrap container 15 is pulled out, the printing unit 51 can be moved from the operation position DP to the maintenance position MP. As a result, a space region required to move the printing unit 51 from the operation position DP to the maintenance position MP can be suppressed from increasing in the main body case 13. Therefore, the printer 11 can be suppressed from increasing in size.

2. When the printing unit 51 is moved from the operation position DP to the maintenance position MP, the link mechanism 60 moves the printing unit 51 from the operation position DP in the gravity direction, at first. Accordingly, since the printing unit 51 can be moved from the operation position DP by free fall of the printing unit 51, for example, a configuration of the link mechanism 60 can be simplified. Further, when the printing unit 51 is made to be located at the maintenance position MP, the printing unit 51 is moved in the right direction as the horizontal direction. Accordingly, the printing unit 51 can be easily moved to the maintenance position MP by drawing in the horizontal direction.

3. For example, when a maintenance operator of the printer 11 pulls out the scrap container 15 to move the printing unit 51 from the operation position DP to the maintenance position MP in order to perform maintenance on the printing unit 51, the direction of pulling out the scrap container 15 and the direction of drawing the printing unit 51 to the outside of the main body case 13 are the same. As a result, when the operator moves the printing unit 51, a probability that the operator can move the printing unit 51 without moving in the wrong direction is increased.

4. When the printing unit 51 is moved from the operation position DP to the maintenance position MP, the printing unit 51 is moved in the gravity direction and the horizontal direction (right direction) at the same time by the link mechanism 60. Thereafter, the printing unit 51 is further moved to the outside of the main body case 13 by the slide mechanism 70. Accordingly, when the printing unit 51 is drawn to the outside of the main body case 13, in a case where a large slide amount in the right direction is needed, the printing unit 51 can be moved to the outside of the main body case 13 by providing the link mechanism 60 and the slide mechanism 70 in the above manner.

5. The printing unit 51 can be positioned at the operation position with the guiding pins 56*p* projected from the direction opposite to the gravity direction side to the gravity direction side by moving the printing unit 51 from the gravity direction side to the direction opposite to the gravity direction side. At this time, if a state before positioning is made to be a floating state, a positional error of the printing unit 51 in the vertical direction and the horizontal direction, which is caused in the state before positioning, is absorbed. Therefore, the printing unit 51 can be positioned at the operation position DP accurately.

6. Since the scrap container 15 is a container in which cut pieces Pk of the paper P are accumulated, the scrap container 15 is required to occupy a space region enough to reliably take in and accumulate the cut pieces Pk in the main body case 13. Further, since the printing unit 51 performs printing on the paper Ps after being cut, the printing unit 51 is arranged in the vicinity of the scrap container 15 accumulating the cut pieces Pk. Accordingly, the occupied space region 15S occupied by the scrap container 15 can be used for the movement path on which the printing unit 51 is moved for maintenance.

It is to be noted that the above embodiment may be changed to the following other embodiments.

In the above embodiment, the link mechanism 60 may not be necessarily used. For example, the printing unit 51 may be moved from the operation position DP to the maintenance position MP by all slide movement by a slide mechanism. The variation is described with reference to FIG. 5. It is to be noted that same reference numerals denote same constituent components as those in the above embodiment, and descriptions thereof are omitted.

Figure 5:
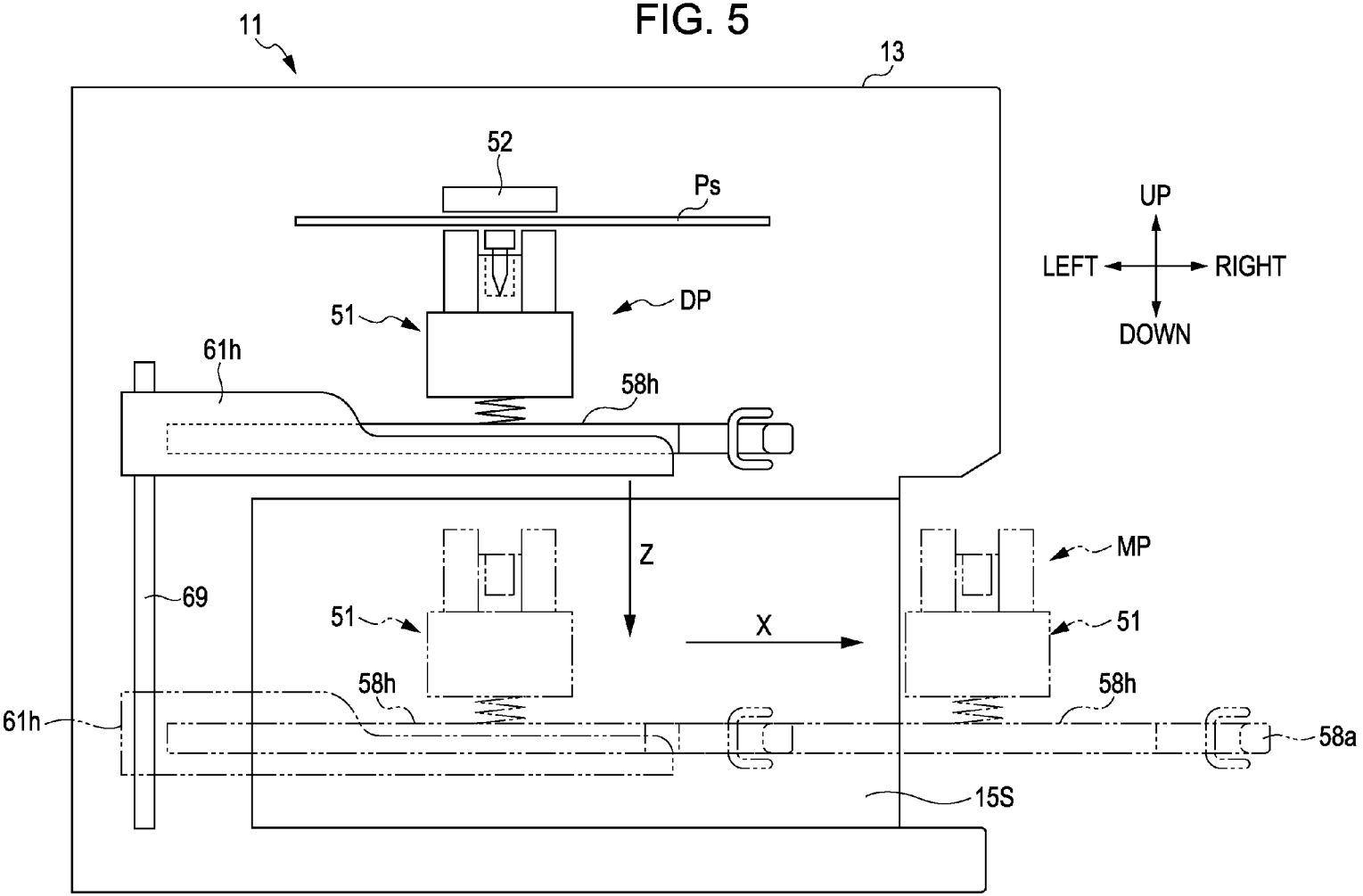
FIG. 5 is a configuration descriptive view of a movement method of moving the printing unit without using the link mechanism in a case where the printing unit is moved from the operation position to the maintenance position in a variation.

As illustrated in FIG. 5, in the printer 11, two guiding shafts 69 are arranged at the front and rear sides (in the direction perpendicular to the paper plane) at the backward side as the left side of the occupied space region 15S. An axial direction of each guiding shaft 69 is the upward-downward direction. A base 61*h* is attached so as to engage with the guiding shafts 69 such that the base 61*h* is slidingly moved in the upward-downward direction. A movement table 58*h* is provided on the base 61*h* so as to be slidable in the left-right direction. The movement table 58*h* has a shape longer than the movement table 58 in the above embodiment in the left-right direction, for example, so that a large slide amount can be obtained.

In the variation configured as described above, if the printing unit 51 located at the operation position DP is unlocked after the scrap container 15 has been pulled out, the printing unit 51 slides (descends) in the downward direction on a movement path Z, at first, as illustrated in FIG. 5. At this time, a damper force is generated by dampers (linear dampers) (not illustrated) provided on the guiding shafts 69. After the printing unit 51 has descended, the printing unit 51 is slid in the right direction on a movement path X by gripping the drawer handle 58*a* and drawing the movement table 58*h* in the right direction. Thus, the printing unit 51 can be moved from the operation position DP to the maintenance position MP using the occupied space region 15S with two slide movements without using the link mechanism. It is to be noted that in the variation, since the printing unit 51 is moved toward the operation position DP in the vertical direction, positioning of the printing unit 51 with engagement between the guiding pins 56*p* and the guiding holes 55*h* is reliably performed.

In the above embodiment, the printing unit 51 may be located at the outside of the main body case 13 using an occupied space region of a functional part other than the scrap container 15. For example, when a waste ink tank (not illustrated) in which waste liquid of ink is accumulated, which is used in the printer 11, is included as a functional part, the waste ink tank is arranged at a lower portion of the main body case 13 in the printer 11 in a detachable manner in many cases. If the waste ink tank is arranged on the lower portion of the printing unit 51, for example, the waste ink tank can be used as a second functional part in the same manner as the scrap container 15. That is to say, the printing unit 51 can be moved from the operation position DP to the maintenance position MP using the occupied space region of the waste ink tank.

In the above embodiment, the printing unit 51 is moved to the lower side, that is, in the gravity direction. However, the printing unit 51 may be moved to the upper side, that is, in the direction opposite to the gravity direction side. For example, the printing unit 51 may be moved to the outside of the main body case 13 using an occupied space region when a heater unit 80 arranged at the upper surface side of the transported paper Ps is attached. The variation is described with reference to FIG. 6. It is to be noted that same reference numerals denote same constituent components as those in the above embodiment, and descriptions thereof are omitted.

Figure 6:
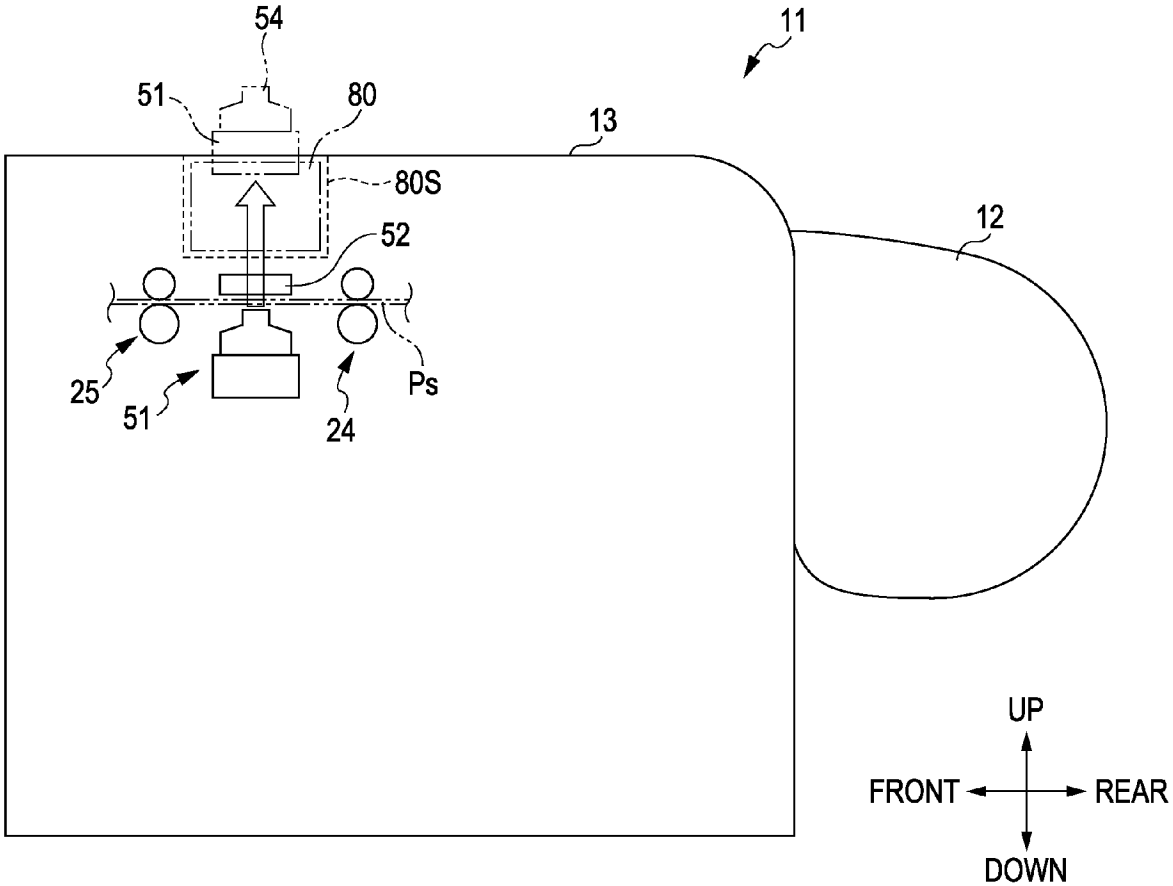
FIG. 6 is a configuration descriptive view utilizing an occupied space of a functional part other than a scrap container in another variation.

As illustrated in FIG. 6, in the printer 11, the heater unit 80 is provided in the occupied space region 80S in the main body case 13 in a detachable manner. The heater unit 80 having a substantially rectangular parallelepiped shape blows out hot air onto the recorded paper Ps for drying recording liquid on the paper Ps. In the variation, the heater unit 80 is arranged at the upper side of the printing unit 51. The printing unit 51 is located at the outside of the main body case 13 by using an occupied space region 80S as the movement path.

For example, in the variation, in a state where the paper Ps is not being transported, the supporting table 52 located at the backward side and the lower side with respect to the occupied space region 80S can be slidingly moved in the left direction or the right direction. The printing unit 51, which is exposed after the supporting table 52 has been slidingly moved, can be made to pass through between the transportation roller pairs 24, 25 and moved in the upward direction as illustrated in a dashed line in FIG. 6. The printing unit 51 can be moved in the upward direction by a link mechanism (not illustrated) or a slide mechanism (not illustrated) as in the above embodiment. In such a manner, the printing unit 51 can be moved from the operation position DP to the maintenance position MP with the movement in the upward direction.

In the above embodiment, when the printing unit 51 is located at the outside of the main body case 13 by the link mechanism 60, the slide mechanism 70 which makes the movement table 58 slide to the right side may not be included. With this, for example, the base 61 and the movement table 58 can be integrally formed so that the configuration thereof can be simplified.

In the above embodiment, the link mechanism 60 is configured to move the printing unit 51 along a face perpendicular to the front-rear direction. However, the link mechanism 60 may be configured to move the printing unit 51 along a face inclined with respect to the front-rear direction. When the scrap container 15 is attached at not a position just under the printing unit 51 but a position deviated with respect to the printing unit 51 in the front-rear direction, the link mechanism 60 moves the printing unit 51 not in the directly downward direction but in the obliquely downward direction. With this, the movement path of the printing unit 51 can be located in the occupied space region 15S, thereby using the occupied space region 15S.

In the above embodiment, the scrap container 15 and the printing unit 51 may be configured to be drawn in the front-rear direction which is the same as the transportation direction of the paper P. The printing unit 51 can be moved from the operation position DP to the maintenance position MP by setting the movement direction in such manner depending on the configuration of the printer 11.

In the above embodiment, the direction of pulling out the scrap container 15 may be different from the direction of drawing the printing unit 51. The configuration in which the pulling-out direction and the drawing direction are different from each other may be included depending on the configuration of the printer 11.

In the above embodiment, it is needless to say that the first functional part is not necessarily limited to the printing unit 51. As the first functional part, any part may be used as long as maintenance is required to be performed on the part, the part is arranged in the main body case 13 when the printer 11 is being operated and the maintenance cannot be easily performed on the part from the outside of the case.

In the above embodiment, the ink jet printer 11 which ejects ink is employed as an example of recording apparatuses. However, recording apparatuses which eject and discharge liquids other than ink may be employed. The invention can be applied to various types of recording apparatuses including a liquid ejecting head which discharges a trace amount of liquid droplets, and the like. In this case, the terminology "liquid droplets" represents a state of liquid which is discharged from the above recording apparatus. For example, a granule form, a teardrop form, and a form that pulls tails in a string-like form therebehind are included as the liquid droplets. The terminology "liquid" here represents materials which can be ejected by the recording apparatus. For example, any materials are included as long as the materials are in a liquid phase. For example, materials in a liquid state having high viscosity or low viscosity, or a fluid state such as sol, gel water, other inorganic solvents, an organic solvent, a solution, a liquid resin or a liquid metal (molten metal) can be included as the liquid. Further, the liquid is not limited to liquid as one state of a material but includes a solution in which particles of functional materials made of solid materials such as pigment and metal particles are dissolved, dispersed, or mixed in a solvent. A typical example of the liquid is ink described in the above embodiment. The terminology "ink" here encompasses various liquid compositions such as common aqueous ink and oil ink, gel ink and hot melt ink. A specific example of the recording apparatus is not limited to the apparatus which includes a roll paper obtained by winding a paper in a roll form in a container (case 12) as described in the above embodiment. For example, any apparatus can be employed as the recording apparatus as long as the apparatus includes a long recording material such as a substrate or a metal plate having flexibility, a plastic sheet or a fabric, which is wound in a roll form, in a container. Further, the long recording medium included in the container may not be necessarily wound in the roll form. For example, the long recording medium may be in a zigzag form.

In the above embodiment, apparatuses other than the recording apparatus may be employed as one type of the multifunctional apparatus. The invention can be applied to any apparatus as long as the apparatus includes a functional part on which maintenance is required to be performed and a functional part which is detachably attached to the main body case.

What is claimed is:

1. A multifunctional apparatus comprising:

a housing;

a first functional part located at a defined operation position in the housing when the multifunctional apparatus is operated, the first functional part being configured to be moved by a movement unit to a maintenance position on the outside of the housing when maintenance is to be performed on the first functional part, the first functional part being attached to the multifunctional apparatus when in the maintenance position;

a second functional part located in the housing of the multifunctional apparatus when the multifunctional apparatus is operated, the second functional part being configured to be detachably attached to the housing of the multifunctional apparatus, the first functional part and the second function part having different functions; and a movement path on which the first functional part is moved from the operation position within the housing to the maintenance position outside of the housing by the movement unit, the movement path including at least a portion of an occupied space region occupied by the second functional part in the housing when the second functional part is attached to the multifunctional apparatus.

2. The multifunctional apparatus according to claim 1, wherein the first functional part is moved from the operation position to a gravity direction side in the vertical direction and is moved in the horizontal direction so as to be located at the maintenance position by the movement unit.

3. The multifunctional apparatus according to claim 1, wherein a movement direction of the first functional part when the first functional part is moved to the maintenance position by the movement unit is the same as a direction to which the attached second functional part is pulled out from the housing.

4. The multifunctional apparatus according to claim 1, wherein the movement unit includes a link mechanism which moves one base on which a movement table is provided with four link members and a slide mechanism which makes the movement table provided on the base slide in the same direction as the direction to which the second functional part is pulled out from the housing, and the first functional part is placed on the movement table.

5. The multifunctional apparatus according to claim 1, wherein when the first functional part is moved from the maintenance position to the operation position, the first functional part is moved by the movement unit in a floating state where the position of the first functional part in the vertical direction and the horizontal direction is not fixed, and wherein when the first functional part is located at the operation position, the position of the first functional part in the vertical direction and the horizontal direction is determined by a positioning member so that the first functional part is positioned at the operation position.

6. The multifunctional apparatus according to claim 1, wherein the multifunctional apparatus has a function of cutting a recording medium having a plurality of recording regions on one face for each of the recording regions, and a function of performing printing on the cut recording medium at a face opposite to the one face, the first functional part is a printing unit which performs printing on the face opposite to the one face, and the second functional part is a container in which cut pieces of the recording medium generated between the recording regions by the cutting are accumulated.

7. The multifunctional apparatus according to claim 6, further including:

a transportation unit which transports the recording medium, and a liquid ejecting head which ejects recording liquid onto the recording regions of the transported recording medium in a gravity direction to perform recording on the recording regions, wherein the multifunctional apparatus functions as a recording apparatus printing onto the recording medium.

* * * * *